US009717297B2

(12) United States Patent
Harris

(10) Patent No.: US 9,717,297 B2
(45) Date of Patent: Aug. 1, 2017

(54) SHELL FOR A PROTECTIVE HELMET

(71) Applicant: Lenard Harris, Garden City, GA (US)

(72) Inventor: Lenard Harris, Garden City, GA (US)

( * ) Notice: Subject to any disclaimer, the term of this patent is extended or adjusted under 35 U.S.C. 154(b) by 46 days.

(21) Appl. No.: 14/801,940

(22) Filed: Jul. 17, 2015

(65) Prior Publication Data

US 2016/0007669 A1 Jan. 14, 2016

Related U.S. Application Data

(63) Continuation-in-part of application No. 14/265,937, filed on Apr. 30, 2014, now abandoned.

(60) Provisional application No. 61/829,623, filed on May 31, 2013.

(51) Int. Cl.

| | |
|---|---|
| ***A42B 3/00*** | (2006.01) |
| ***A42B 3/12*** | (2006.01) |
| ***A42B 3/06*** | (2006.01) |

(52) U.S. Cl.

CPC ..... *A42B 3/121* (2013.01); *A42B 3/065* (2013.01)

(58) Field of Classification Search

CPC ..... A42B 3/00; A42B 3/322; A42B 3/228; A42B 3/08; A42B 1/046; A47G 19/2255; B67B 7/0411; A63B 71/10

USPC ..... 2/411, 410, 421, 6.4, 425, 205

See application file for complete search history.

(56) References Cited

U.S. PATENT DOCUMENTS

| | | | | |
|---|---|---|---|---|
| 2,194,903 | A | 3/1940 | Holstein | |
| 3,197,784 | A * | 8/1965 | Carlisle | A42B 3/00 2/420 |
| 3,872,511 | A | 3/1975 | Nichols | |
| 4,223,409 | A | 9/1980 | Lee | |
| 4,766,614 | A | 8/1988 | Cantwell et al. | |
| 4,937,888 | A | 7/1990 | Straus | |
| 5,575,017 | A * | 11/1996 | Hefling | A42B 3/145 2/418 |
| 5,687,426 | A | 11/1997 | Sperber | |
| 5,694,649 | A * | 12/1997 | Hefling | A42B 3/145 2/418 |
| 5,770,124 | A * | 6/1998 | Marecki | G02B 5/124 264/1.36 |
| 5,804,757 | A * | 9/1998 | Wynne | F41H 5/0428 2/2.5 |
| 5,815,846 | A | 10/1998 | Calonge | |

(Continued)

FOREIGN PATENT DOCUMENTS

| | | |
|---|---|---|
| DE | 458497 | 4/1928 |
| EP | 2 147 606 A1 | 1/2010 |

(Continued)

*Primary Examiner* — Clinton T Ostrup
*Assistant Examiner* — Bao-Thieu L Nguyen

(57) ABSTRACT

An improved protective shell for a helmet, where the shell has angled panels forming pyramid-like surface structures covering the surface of the helmet. Each pyramid-like structure has three or more panels conjoining to form an apex. In one embodiment, each of the panels is a triangle having a base and a point that conjoins adjacent panels, thereby forming the apex. The limited number of apex points and the orientation of the angled panels reduce the probability that an impacting object will deliver a square blow to the helmet. The probability is increased that such blows will be only glancing in nature, thereby reducing the severity of the blow and head injury to the wearer.

20 Claims, 5 Drawing Sheets

(56) References Cited

U.S. PATENT DOCUMENTS

| | | | | |
|---|---|---|---|---|
| 5,840,405 | A * | 11/1998 | Shusta | G02B 5/124 359/529 |
| 5,940,890 | A | 8/1999 | Dallas et al. | |
| 5,974,593 | A * | 11/1999 | McNabb | A42B 3/145 2/414 |
| 6,226,801 | B1 | 5/2001 | Alexander et al. | |
| 6,260,212 | B1 * | 7/2001 | Orotelli | A42B 3/06 2/410 |
| 6,314,586 | B1 | 11/2001 | Duguid | |
| 6,363,539 | B2 * | 4/2002 | Tachi | A42B 3/06 2/410 |
| 7,240,376 | B2 | 7/2007 | Ide et al. | |
| 7,673,351 | B2 | 3/2010 | Copeland et al. | |
| 7,954,177 | B2 | 6/2011 | Ide et al. | |
| 8,640,267 | B1 | 2/2014 | Cohen | |
| 8,814,150 | B2 | 8/2014 | Ferrara et al. | |
| 8,950,735 | B2 | 2/2015 | Reynolds et al. | |
| 2003/0028951 | A1 * | 2/2003 | Mitsuhashi | A42B 1/004 2/171.02 |
| 2005/0278835 | A1 | 12/2005 | Ide et al. | |
| 2008/0134413 | A1 * | 6/2008 | Guo | A42B 1/24 2/171.02 |
| 2008/0256686 | A1 | 10/2008 | Ferrara | |
| 2011/0107503 | A1 | 5/2011 | Morgan | |
| 2011/0179557 | A1 | 7/2011 | Rable | |
| 2012/0204327 | A1 * | 8/2012 | Faden | A41D 31/005 2/411 |
| 2012/0210490 | A1 * | 8/2012 | Harty | A42B 3/285 2/171.2 |
| 2012/0216339 | A1 | 8/2012 | Nimmons et al. | |
| 2012/0266366 | A1 | 10/2012 | Ferrara | |
| 2012/0297525 | A1 | 11/2012 | Bain | |
| 2012/0297526 | A1 * | 11/2012 | Leon | A42B 3/12 2/413 |
| 2013/0061371 | A1 | 3/2013 | Phipps et al. | |
| 2013/0174331 | A1 | 7/2013 | Witcher | |
| 2015/0366281 | A1 * | 12/2015 | Miller | B32B 27/12 428/136 |

FOREIGN PATENT DOCUMENTS

| | | |
|---|---|---|
| WO | PCT/US92/06227 | 2/1993 |
| WO | WO 2012/094733 | 7/2012 |

* cited by examiner

SHELL FOR A PROTECTIVE HELMET

CROSS-REFERENCE TO RELATED APPLICATION

Pursuant to 35 U.S.C. §§119(e) and 120, this application is a continuation-in-part application of U.S. patent application Ser. No. 14/265,937, filed on Apr. 30, 2014, which claimed the benefit of U.S. Provisional Patent Application Ser. No. 61/829,623, filed on May 31, 2013, the entire contents of each of which are incorporated herein by this reference.

BACKGROUND (1) Technical Field

This invention relates generally to protective headwear, and more particularly to an improved outer shell for a helmet, where the shell reduces the wearer's head trauma caused by impact to the shell.

(2) Background

Protective helmets are intended to reduce the wearer's head injuries or head trauma caused by impact to the helmet. Injury causing impact forces are delivered by impact from a variety of objects, such as falling objects at a construction site, colliding helmets of opposing football players, or flying projectiles such as baseballs or other objects. Protective helmets are worn by construction workers and participants in many sports, such as football, baseball, lacrosse, bicycling, horseback riding, skateboarding, skiing, and many other sports and events. As one example, football and other contact sports can be a highly dangerous activity due in part to extreme forces impacting players in the head region. To reduce injury, football organizations mandate the use of safety helmets. The use of helmets can greatly reduce the trauma and resulting injury associated with blows to the head. Many football players and other athletes suffer concussions, memory loss, spinal and neck injuries, and similar conditions during games and practices. Although players wear helmets, the helmets are not ideally designed to prevent as many injuries as possible. There is a need for improved safety helmets for athletes.

The present invention is directed to an improved protective helmet, and more specifically to an improved outer shell that reduces the force of impact transferred to the wearer's head.

SUMMARY OF THE PREFERRED EMBODIMENTS

The present protective helmet comprises an outer shell having an arrangement of flat panels oriented at different angles to form intersection points, or a apex points, at locations where three or more panels intersect. In one embodiment, the panels are triangles that form a multi-sided pyramid-like feature on the surface of the outer shell, where the pyramid culminates at the apex. In this embodiment, the pyramid could have three or more sides, or panels, for each apex. Each panel comprises a base and a point, with the respective points conjoining at the apex. The base of each panel has a shorter radius from the center of the helmet than does the apex. The outer shell comprises multiple apex points dispersed about the outer surface of the outer shell.

In another embodiment, the outer shell comprises at least three flat surface panels, wherein three or more panels conjoin at a common point, each of said three or more panels being oriented in a different plane such that the common point forms an apex in relation to the conjoining three or more panels. In this embodiment, the panels are polygons having or more sides. An apex can be formed by combining panels of differently shaped polygons, such as by conjoining three different panels having three-sides, four-sides, and six-sides, respectively.

The irregular surface caused by the raised apex points minimizes the points on the outer shell where the helmets of opposing football players can collide in square contact or substantially square contact. The present outer shell increases the probability that opposing football players will deliver only glancing helmet-to-helmet blows to each other, thereby reducing the probability that the wearer of the helmet will experience serious head trauma or injury.

Another embodiment comprises an inner shell disposed inside and spaced apart from the outer shell. The space between the respective shells forms an air cushion layer that provides additional cushioning, or damping, to the wearer's head upon an impact event. One or more apexes of the outer shell has a hole disposed in fluid communication with the air cushion layer such that the hole enables air ingress and egress to and from the air cushion layer.

DETAILED DESCRIPTION OF THE PREFERRED EMBODIMENTS

With reference to the drawings, the protective helmet will now be described with regard for the best mode and the preferred embodiment. In general, the protective helmet disclosed herein is configured for reducing head trauma caused by impact with another helmet or projectile. The embodiments disclosed herein are meant for illustration and not limitation of the invention. An ordinary practitioner will appreciate that it is possible to create many variations of the following embodiments without undue experimentation.

Protective helmets, and therefore the present protective shell, are typically fitted to the wearers head, and these helmets are therefore substantially spherical or substantially round in shape. For the purposes of this discussion, the term "center" refers to the geometric center of the spherical or round helmet, and the term "radius" refers to the linear distance from the center to a given point.

The present protective outer shell is suitable for use with a variety of protective helmets, such as helmets used in the construction industry or a variety of sporting events, such as football, baseball, biking, skiing, and other activities. For the purposes of discussion and illustration of the protective shell, and not for the purpose of limiting the scope of the invention, the following description is set forth in the context of football helmets. An ordinary practitioner will readily appreciate that the principles of the protective shell discussed herein are suitable for adaptation to any of the foregoing uses, as well as many others.

Football is a sport that requires a high degree of athleticism, and due to the unpredictable player maneuvering in the game any player could be hit in the helmet from any angle at any time. However, the traditional player alignment on the field and the athletic fundamentals of the game dictate that the majority of head impact events experienced by football players are to the forehead area, top of the helmet, and the back of the helmet. For example, ball carriers often lower their heads when being tackled, thereby exposing the forehead area and the top of the helmet to impact from the helmet of the tackler. As another example, receivers are frequently hit from behind when catching a pass, and these players often receive impact to the back of the helmet. In short, although any point on a football helmet can receive contact, there are certain zones of the helmet that are struck more frequently and more violently than others. The present outer shell 10 is therefore adaptable in these high impact zones in order to minimize the head trauma experienced by players receiving head impact.

Figure 1:
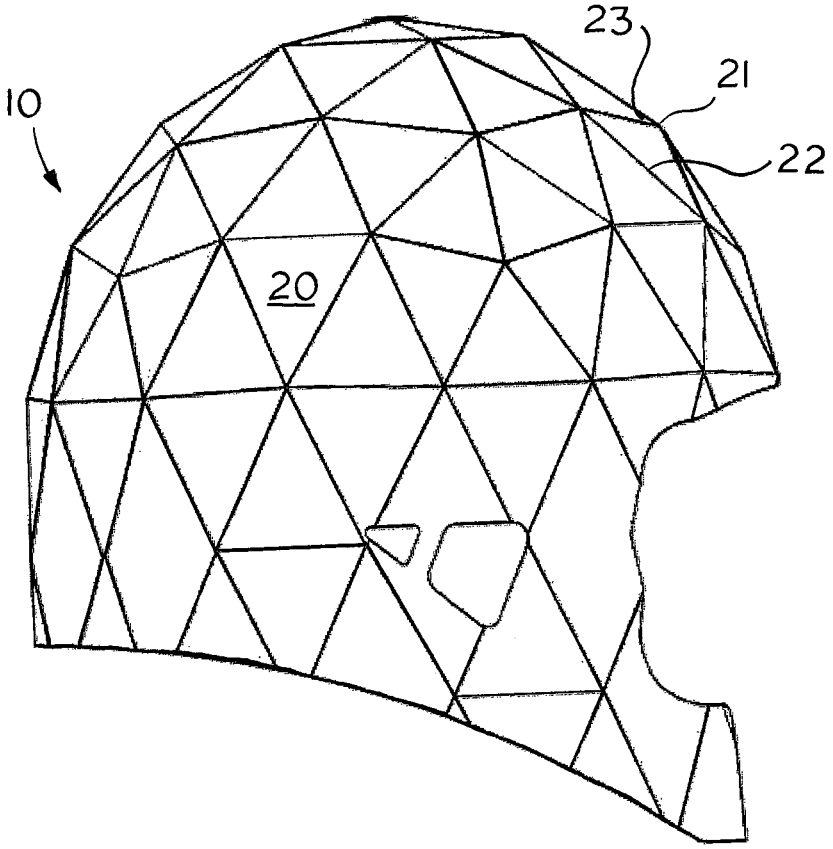
FIG. 1 shows a side view of a typical helmet comprising one embodiment of the protective outer shell taught herein.
Figure 2:
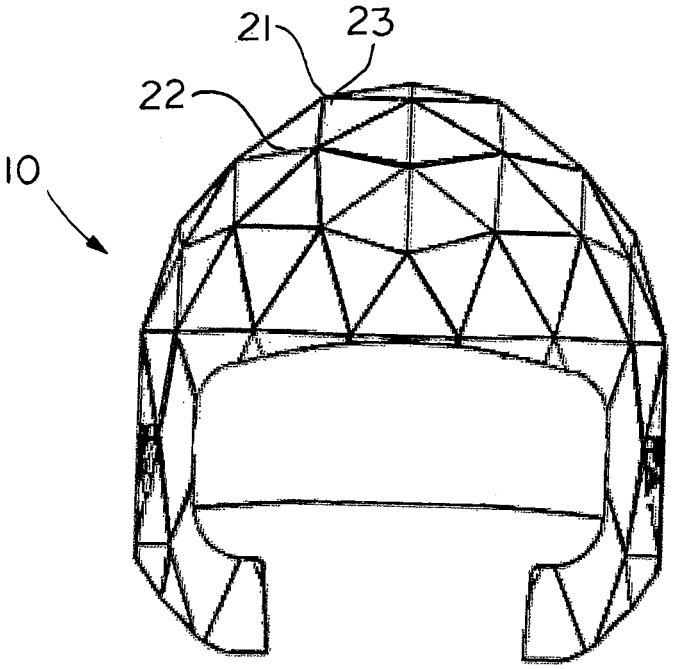
FIG. 2 shows a front view of a typical helmet comprising one embodiment of the protective outer shell taught herein.

Referring to FIG. 1 and FIG. 2, the outside surface 19 of the outer shell 10 comprises an arrangement of flat panels 20 oriented a different angles to form intersection points, or an apex, 21 at locations where three or more panels 20 intersect. For most embodiments of the outer shell, the apex 21 is generally located at a greater radius from the center of the helmet than any point on the panels 20 that form the apex 21.

Figure 3:
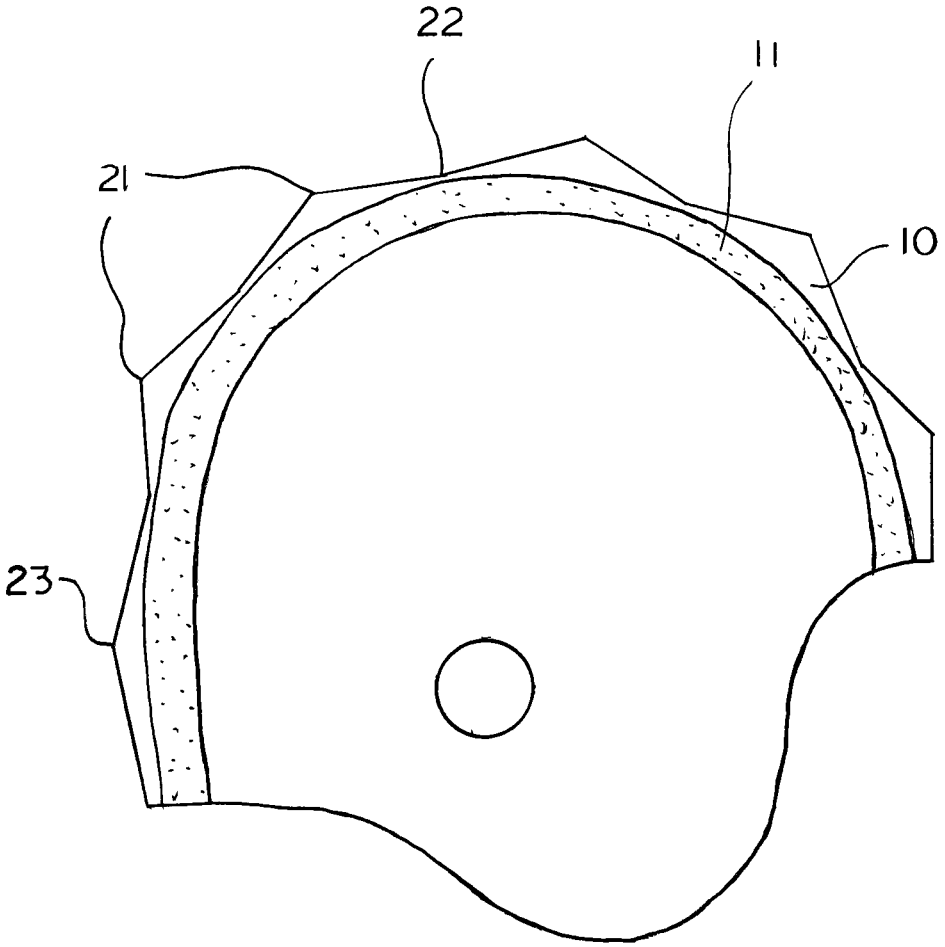
FIG. 3 is a cross section view of a typical helmet comprising one embodiment of the protective outer shell taught herein.

In one embodiment, the panels 20 are triangles that form a multi-sided pyramid-like feature on the outside surface 19 of the outer shell 10, where the pyramid culminates at the apex 21. In this embodiment, the pyramid could have three or more sides, or panels 20, for each apex 21. Each panel 20 comprises a base 22 and a point 23, with the point 23 culminating at the apex 21. The base 22 has a shorter radius from the center of the helmet than does the apex 21. In other embodiments, the outer shell 10 comprises panels 20 that are polygons having more than three sides, such as pentagons, hexagons, octagons, or the like. Referring to FIG. 3, the outer shell 10 overlays the conventional padding 11 of the football helmet.

The outer shell 10 comprises multiple apex 21 points dispersed about the outer surface of the outer shell 10. Adjacent apexes 21 may have bases 22 in contact with each other, or there may be a space or gap between the respective bases 22. The radius of each apex 21 is selected to ensure that each apex 21 is raised a sufficient distance from its base 22 such that the panels 20 create a pronounced irregular outside surface 19 of the outer shell 10.

In another embodiment, the outer shell 10 comprises at least three flat surface panels 20, wherein three or more panels 20 conjoin at a common point, each of said three or more panels 20 being oriented in a different plane such that the common point forms an apex 21 in relation to the conjoining three or more panels 20. In this embodiment, the panels 20 are polygons having 3 or more sides. While the number of sides varies according to the optimum use of the particular application, three-, four-, five-, six-, or eight-sided panels 20 are suitable for most applications. An apex 21 can be formed by combining panels 20 of differently shaped polygons. For example, an apex 21 may be formed by conjoining three different panels 20 having three-sides, four-sides, and six-sides, respectively.

The irregular surface caused by the raised apex 21 points minimizes the points on the shell where the helmets of opposing football players can collide in square contact or substantially square contact. More specifically, conventional football helmets have a substantially smooth, round surface. Because of this geometry, there are theoretically an infinite number of points on the surface of a conventional football helmet that can receive square contact from the helmet of an opposing player. Square contact occurs when the impact force vector caused by the opposing player is perpendicular to the surface of the receiving player's helmet. By contrast, the present shell minimizes the number of points on the helmet where opposing players can deliver respective helmet-to-helmet blows in which the respective force vectors are perpendicular to the surface of the outer shell 10. In other words, the present outer shell 10 increases the probability that opposing football players will deliver only glancing helmet-to-helmet blows to each other. Due to the glancing nature of these blows, the magnitude of the impact force is reduced, thereby reducing the probability that the wearer of the helmet will experience serious head trauma or injury.

Figure 4:
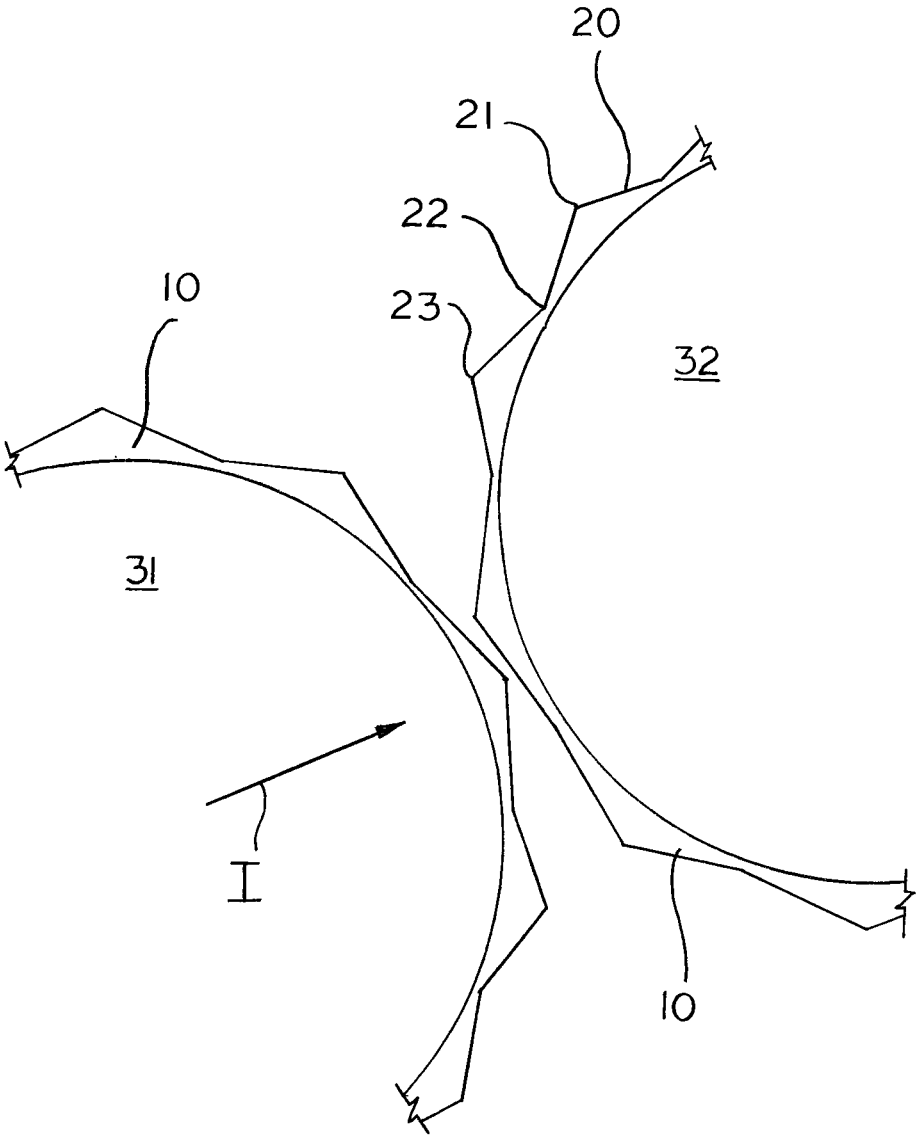
FIG. 4 is a partial cross section view showing the geometry of typical impact of two helmets comprising one embodiment of the protective outer shell taught herein.
Figure 5:
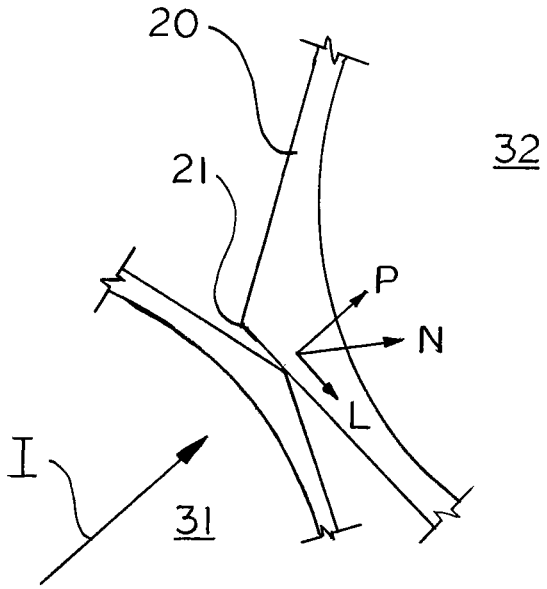
FIG. 5 is a partial cross section view showing the geometry of typical impact of two helmets comprising one embodiment of the protective outer shell taught herein.

Referring to FIG. 4 and FIG. 5, the glancing nature of the impact vectors is illustrated. When two helmets 31, 32 collide, a first helmet 31 delivers a blow described by impact force vector I. If the collision occurs at an apex 21 on the respective helmets 31, 32, then the resulting force to the players' heads is no more severe than for players wearing conventional football helmets. However, there is a very low probability of the contact point occurring at the apex 21 points on the respective helmets 31, 32. Instead, off-center collisions, illustrated in FIG. 5, are much more common. In these off-center hits, the impact vector I delivered by the first helmet 31 delivers only a glancing blow to the second helmet 32. More specifically, the apex 21 of the first helmet 31 contacts the angled panel 20 of the second helmet 32. Thus, instead of a perpendicular force vector N delivered to the second player's head, a force vector P is delivered. The magnitude of force P is lower than the magnitude of force N because the impact vector I contacts the second helmet 32 at an angled orientation than glances off of the angled panel 20 of the second helmet 32. The force vector L represents the amount of force P deflected as a lateral glancing force.

The present outer shell 10 is suitable for use with other safety features of conventional football helmets, such features including padding, accelerometers to measure the severity of impact, dampers to reduce the dynamic effect of impact, or other such devices. The panels 20 in the outer shell 10 are made of a durable hard material, such as fiberglass, plastic, carbon fiber, or other such material. The material should be hard enough so that it does not crush under the magnitude of impact force vector I.

Figure 6:
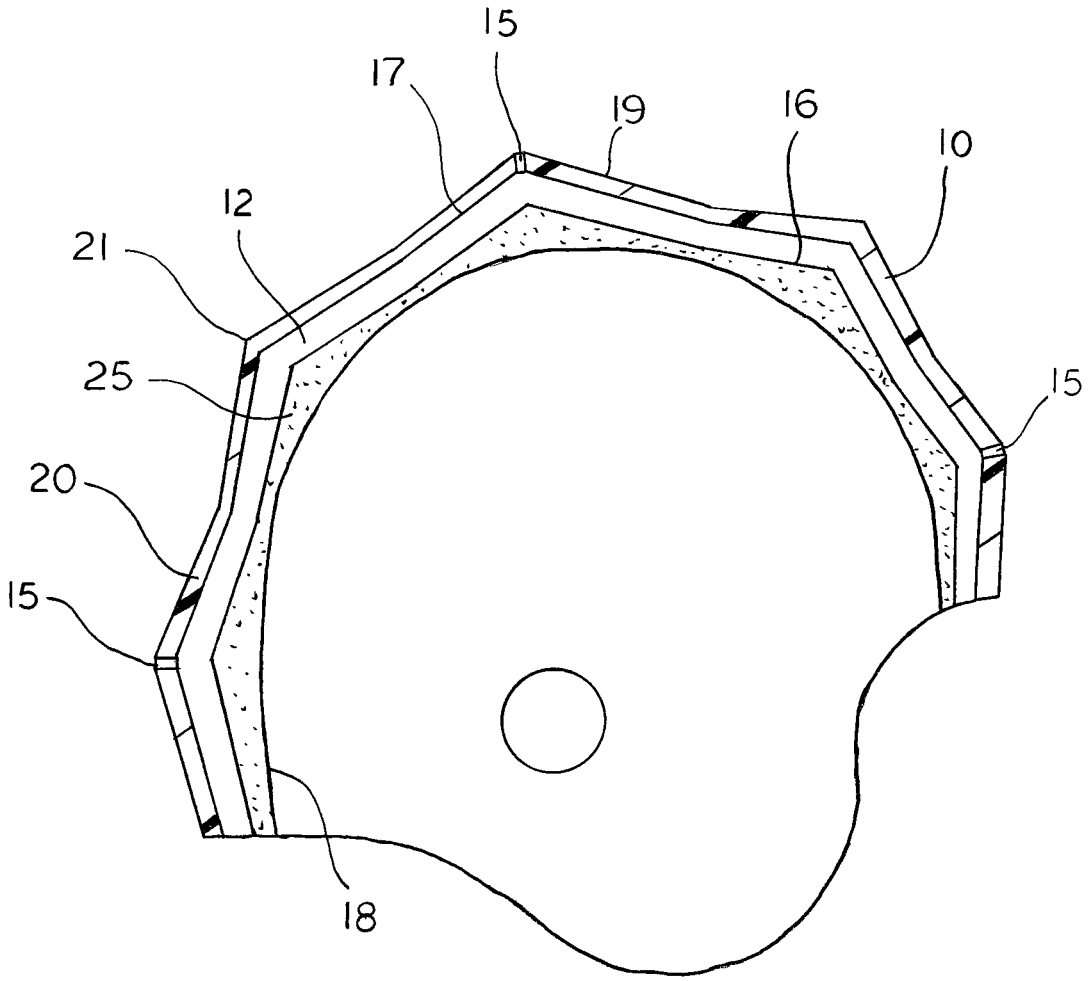
FIG. 6 is a cross section of an embodiment of the protective helmet having an inner shell and an air cushion layer.

In another embodiment, shown in FIG. 6, the helmet comprises an inner shell 25 configured to mate with the outer shell 10 of the helmet. The inner shell 25 comprises a low-density cushioning foam, such as polystyrene foam. This low-density cushioning material functions as padding inside the helmet, providing a force-absorbing member between the outer shell 10 and the wearer's head. The outer shell 10 and the inner shell 25 are spaced apart, thereby forming an air cushion layer 12 between the respective shells 10, 11, which acts as an air cushion or damper. At least one pyramid of the outer shell 10 comprises a hole 15 at the apex 21. The hole 15 functions as a vent to allow air ingress and egress through the outer shell 10 to and from the air cushion layer 12. Alternately, a plurality of pyramids comprise a hole 15 at the apex 21 for the same purpose.

The inner shell 25 has a top surface 16, and the outer shell 10 has an inside surface 17. The top surface 16 is contoured to mate with the contours of the pyramids on the underside of the outer shell 10. The opposite surface of the inner shell 25, or the bottom surface 18, is contoured to fit snugly against the wearer's head.

In use, when an object impacts the outer shell 10, the two shells 10, 11 tend to move together, thereby compressing the air cushion layer 12. The compression in the air cushion layer 12 causes air pressure to build inside the layer 12. This buildup in air pressure is relieved through the air holes 15 at the apex 21 of the pyramids in the outer shell 10. Once the impact force is released, the outer shell 10 and inner shell 25 return to their normal position. During this action, the shells 10, 11 tend to separate apart, thereby enlarging the previously compressed air cushion layer 12. This enlargement, or increase in volume of the air cushion layer 12, causes a decrease in air pressure, or a low pressure imbalance, inside the air cushion layer 12. Atmospheric air enters the air holes 15 and fills the air cushion layer to relive this low pressure imbalance in the air cushion layer 12. Thus, the air holes 15 at each apex 21 enable air ingress and egress to and from the air cushion layer 12 through the outer shell 10.

The egress of air from the air cushion layer 12 is related to the damping function of the air cushion layer 12. Upon impact to the helmet, rapid egress of air from the air cushion layer 12 results in a lower damping, or cushioning, effect generated by the air cushion layer 12. Slower egress of air results in a higher, or more pronounced, damping or cushioning effect generated by the air cushion layer 12. The speed at which air exits the air cushion layer 12 depends on the number and size, or diameter, of the holes 15 disposed in the outer shell 10. A greater number of holes 15 or larger sized holes 15 enable air to exit the air cushion layer 12 relatively rapidly, whereas a fewer number of holes 15 or smaller sized holes 15 tend to inhibit egress of air. Thus, large holes 15 tend to reduce the damping effect of the air cushion layer 12, and smaller holes 15 tend to increase the damping effect caused by the air cushion layer 12. The holes 15 therefore should be sized for the particular use intended for the protective helmet.

Some embodiments of low-density foam in the inner shell 25 can entrap air during the normal state of rest. Upon impact of the helmet, the outer shell 10 is forced toward the wearer's head, causing the outer shell 10 and inner shell 25 to move together and compress the air cushion layer 12, as described above. During this impact event, the foam of the inner shell 25 may also compress, thereby forcing entrapped air to exit the foam material of the inner shell 25, enter into the air cushion layer 12, and ultimately be forced out of the helmet via the holes 15 in the outer shell 10.

The foregoing embodiments are merely representative of the protective shell and not meant for limitation of the invention. For example, one having ordinary skill in the art would readily appreciate that there are several embodiments and configurations of the panels 20 and apex 21 points that render the shell adaptable for alternate uses. Consequently, it is understood that equivalents and substitutions for certain elements and components set forth above are part of the invention described herein, and the true scope of the invention is set forth in the claims below.

I claim:

1. A protective helmet comprising:

an outer shell having an outside surface, an inside surface, and a plurality of surface pyramids disposed on the outside surface, each pyramid comprising three or more panels, each panel having a base and a point, wherein in each pyramid the points of the panels conjoin at the apex of the pyramid, and there are three holes in the outer surface of the outer shell wherein each hole is formed in an apex of the pyramid and the hole passes through the outer shell; and an inner shell disposed inside the protective helmet and spaced apart from the outer shell such that the space between the outer shell and the inner shell forms an air cushion layer;

wherein the outside surface of the outer shell is configured to deflect the impact force caused by objects striking the protective helmet, and the three holes on the outer surface are configured to permit ingress and egress of air to and from the air cushion layer, a damping effect of said air cushion layer being reduced or increased;

wherein the three holes reduce said impact force; and wherein the radius of each of said apex shell is raised a sufficient distance from its base such that said panels create a raised outside surface of said outer shell.

2. The helmet of claim 1, wherein the inside surface of the outer shell is contoured to match the pyramid contours of the outside surface, and the inner shell comprises a top surface having contours configured to mate with the contours of the inside surface of the outer shell.

3. The helmet of claim 1, wherein a plurality of pyramids comprise a plurality of holes disposed in the apexes of the plurality of the pyramids, each hole disposed in fluid communication with the air cushion layer such that the hole permits ingress and egress of air to and from the air cushion layer.

4. The helmet of claim 2, wherein a plurality of pyramids comprise a plurality of holes disposed in the apexes of the plurality of the pyramids, each hole disposed in fluid communication with the air cushion layer such that the hole permits ingress and egress of air to and from the air cushion layer.

5. The helmet of claim 1, wherein the outer shell comprises at least one three-sided pyramid.

6. The helmet of claim 2, wherein the outer shell comprises at least one three-sided pyramid.

7. The helmet of claim 3, wherein the outer shell comprises at least one three-sided pyramid.

8. The helmet of claim 2, wherein the outer shell comprises at least one four-sided pyramid.

9. The helmet of claim 3, wherein the outer shell comprises at least one four-sided pyramid.

10. The helmet of claim 4, wherein the outer shell comprises at least one four-sided pyramid.

11. A protective helmet comprising:

an outer shell having an outside surface, an inside surface, and three or more flat surface panels disposed on the outside surface of the outer shell, the three or more panels conjoining at a common point, each of said three or more panels being oriented in a different plane such that the common point forms an apex in relation to the conjoining three or more panels, and, there are three holes in the outer surface of the outer shell wherein each hole is formed in an apex of the pyramid and the hole passes through the outer shell; and an inner shell disposed inside the protective helmet and spaced apart from the outer shell such that the space between the outer shell and the inner shell forms an air cushion layer;

wherein the outside surface of the outer shell is configured to deflect the impact force caused by objects striking the protective helmet, and the three holes in the outer surface are configured to permit ingress and egress of air to and from the air cushion layer, a damping effect of said air cushion layer being reduced or increased;

wherein the three holes reduce said impact force; and wherein the radius of each of said apex is raised a sufficient distance from its base such that said panels create a raised outside surface of said outer shell.

12. The helmet of claim 11, wherein the inside surface of the outer shell is contoured to match the contours of the flat surface panels of the outside surface, and the inner shell comprises a top surface having contours configured to mate with the contours of the inside surface of the outer shell.

13. The helmet of claim 11, wherein the flat surface panels of the outside surface of the outer shell conjoin to form a plurality of apexes, and a plurality of said apexes comprise a plurality of holes disposed in fluid communication with the air cushion layer such that each hole permits ingress and egress of air to and from the air cushion layer.

14. The helmet of claim 12, wherein the flat surface panels of the outside surface of the outer shell conjoin to form a plurality of apexes, and a plurality of said apexes comprise a plurality of holes disposed in fluid communication with the air cushion layer such that each hole permits ingress and egress of air to and from the air cushion layer.

15. The helmet of claim 11, wherein the outer shell comprises at least one three-sided pyramid.

16. The helmet of claim 12, wherein the outer shell comprises at least one three-sided pyramid.

17. The helmet of claim 13, wherein the outer shell comprises at least one three-sided pyramid.

18. The helmet of claim 12, wherein the outer shell comprises at least one four-sided pyramid.

19. The helmet of claim 13, wherein the outer shell comprises at least one four-sided pyramid.

20. The helmet of claim 14, wherein the outer shell comprises at least one four-sided pyramid.

* * * * *